United States Patent [19]

Oda et al.

[11] Patent Number: 4,933,661

[45] Date of Patent: Jun. 12, 1990

[54] THROTTLE SENSOR FOR AN INTERNAL COMBUSTION ENGINE

[75] Inventors: Yukihisa Oda, Chiryu; Keiji Yasuda, Handa; Takayoshi Tsuzuki, Toyota, all of Japan

[73] Assignee: Aisin Seiki Kabushiki Kaisha, Aichi, Japan

[21] Appl. No.: 102,707

[22] Filed: Sep. 30, 1987

[30] Foreign Application Priority Data

Sep. 30, 1986 [JP] Japan ..... 61-229921

[51] Int. Cl.[5] ..... H01C 10/34

[52] U.S. Cl. ..... 338/174; 338/184; 123/494

[58] Field of Search ..... 338/172, 174, 175, 184, 338/199; 123/494, 482; 73/118.1, 431

[56] References Cited

U.S. PATENT DOCUMENTS

| | | | |
|---|---|---|---|
| 4,051,453 | 9/1977 | Barden | 338/174 X |
| 4,146,866 | 3/1979 | Kirby | 338/174 |
| 4,355,293 | 10/1982 | Driscoll | 123/494 X |
| 4,616,504 | 10/1986 | Overcash et al. | 73/118.1 |
| 4,693,111 | 9/1987 | Arnold et al. | 338/172 X |
| 4,703,649 | 11/1977 | Eitoku et al. | 338/199 X |
| 4,715,220 | 12/1987 | Eitoku et al. | 73/118.1 |
| 4,719,795 | 1/1988 | Eitoku et al. | 73/118.1 |

*Primary Examiner*—E. A. Goldberg
*Assistant Examiner*—M. M. Lateef
*Attorney, Agent, or Firm*—Sughrue, Mion, Zinn, Macpeak & Seas

[57] ABSTRACT

A throttle sensor for an internal combustion engine includes a circuit board and a rotatable body disposed adjacent the circuit board which is connected to the throttle valve and having a pair of brushes disposed in sliding contact with the circuit board. A resistance body, including a basic resistance layer and a protective resistance layer covering a basic resistance layer are formed on the circuit board for engagement by one of the brushes, and a collecting body, including an electric conductive layer and an additional protective resistance layer covering the electric conductive layer is formed on the circuit board for engagement by the other brush. The protective resistance layers protect the basic resistance layers against undue wear and atmospheric conditions.

6 Claims, 5 Drawing Sheets

THROTTLE SENSOR FOR AN INTERNAL COMBUSTION ENGINE

FIELD OF THE INVENTION

The present invention relates to a throttle sensor for detecting the degree of throttle opening of a throttle valve for an internal combustion engine and converting the degree of throttle opening to an electric signal, and more specifically to an analog throttle sensor for transmitting analog signals corresponding to the throttle opening.

DESCRIPTION OF THE PRIOR ART

A vehicle using an internal combustion engine, for example a motor car, possesses a throttle sensor which is a device for measuring the depression of an accelerator and detecting the throttle opening which is used for various control purposes. Throttle sensors of this type may be either digital or analog sensors.

A digital throttle sensor possesses a movable contact which is mounted on a rotary shaft which rotates corresponding to the opening of the throttle valve, and is further provided with fixed contacts on a circuit board. The rotational position of the throttle valve is detected by engagement of the movable contact with the fixed contacts. A signal indicative of the throttle opening is sent to a control device in the form of digital signals which are made as a result of contact and separation between the movable contact and the fixed contacts.

An analog throttle sensor possesses a movable contact which is connected to a rotary shaft which rotates in correspondence to the opening of the throttle valve and further includes a resistance layer on a circuit board. The throttle sensor detects the degree of rotation of the throttle valve by sliding the movable contact on the surface of the resistance layer. A signal indicative of the throttle opening is sent to a control device as an analog signal which is the amount of resistance between one end of the resistance layer and the movable contact. Accordingly, in an analog sensor, there is an advantage since the analog sensor can detect a continuous change. Since the sensor is used in a location which is apt to be exposed to water or dust, both types of throttle sensor are placed in a closed housing.

The digital throttle sensor detects the engagement or separation between two contacts with a fair degree of certainty, even when the contacts are worn due to frictional engagement. However, in an analog throttle sensor, when the resistance is worn or shaved off due to rubbing, the value of the output signal is changed. In an analog throttle sensor it is necessary to use a casing which is more tightly sealed than in the case of a digital throttle sensor, and therefore an analog throttle sensor is considerably larger than a digital throttle sensor. The solid closed structure is fairly complex, and when moisture enters the inside of the sensor it is not readily dischargeable so that there is a danger of a short circuit being generated between the contacts. Furthermore, in an analog throttle sensor, when the throttle valve is moved beyond the rotative limit, the value of the resistance between the contacts may be so small that the resistance is burned if a high voltage is added to the sensor from the outside.

SUMMARY OF THE INVENTION

It is therefore an object of the present invention to miniaturize an analog throttle sensor.

It is another object of the present invention to improve the accuracy and increase the lifetime of an analog throttle sensor.

It is a further object of the present invention to improve the endurance of the throttle sensor against any water.

It is a still further object of the present invention to protect the throttle sensor against an accident of the throttle valve.

Many other features, advantages and additional objects of the present invention will become manifest to those versed in the art upon making reference to the detailed description which follows, and the accompanying sheets of drawings.

DETAILED DESCRIPTION OF THE INVENTION

Figure 1:
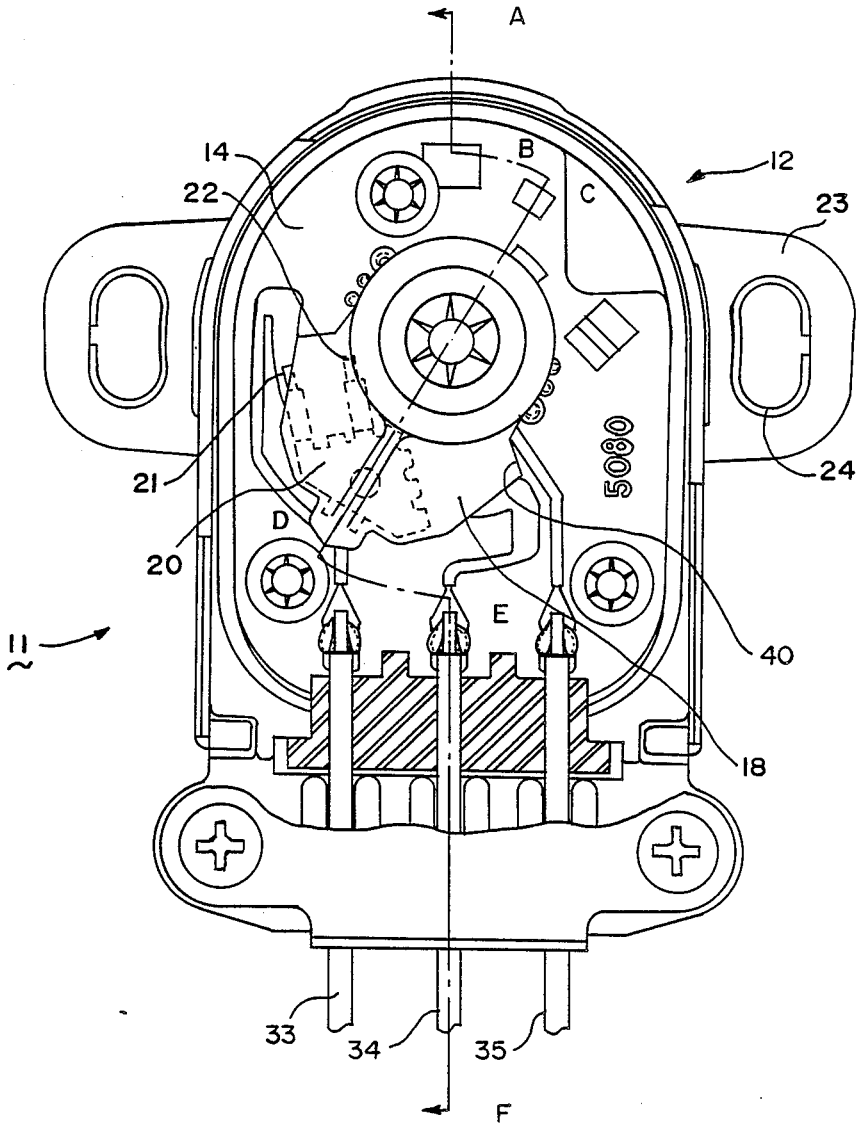
FIG. 1 shows a cross-sectional view of a throttle sensor in accordance with the present invention.
Figure 2:
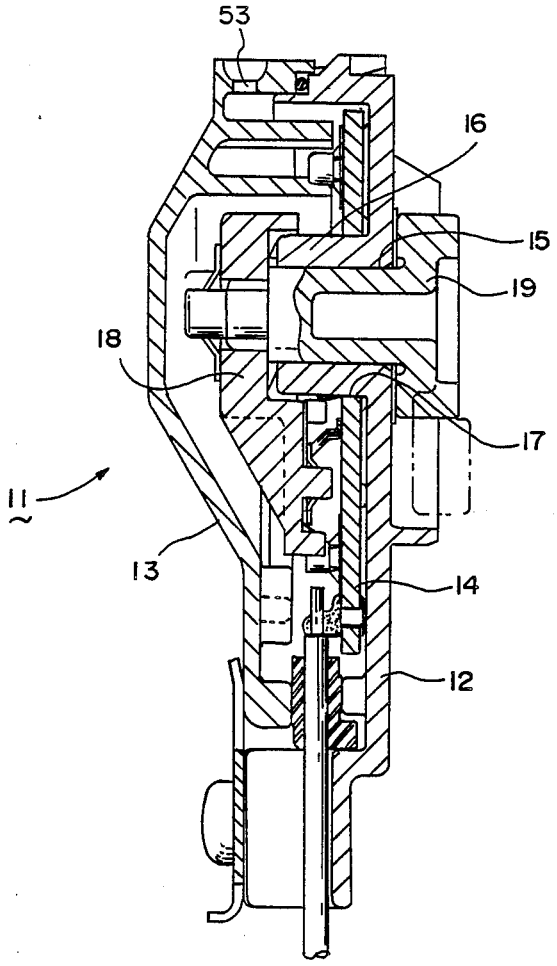
FIG. 2 shows a cross-sectional view taken on the line A-B-C-D-E-F, as shown in FIG. 1.

Referring first to FIGS. 1 and 2, a casing 11 of the throttle sensor is comprised of a housing 12 and a cover 13. The cover 13 has a hole 53 for discharging water which might accumulate within the cover. In the housing 12, a hole 15 is formed in the center thereof and a projection 16 is disposed around the hole 15. The projection 16 is formed vertically on the surface of the housing 12. A circuit board 14 is disposed on the housing 12 and is provided with a hole 17 into which the projection 16 extends.

An axle 19 connecting to a sliding body 18 is rotatably disposed through the hole 15. The sliding body is provided with a projection 40 and a sliding element 20. The sliding element 20 is comprised of an electric conductor and is provided with two brushes 21 and 22. Two brackets 23 extend to either side of the housing 12, and are provided with installation holes 24. The axle 19 is engaged with an operative body (not shown), which is connected to a throttle valve.

Figure 3:
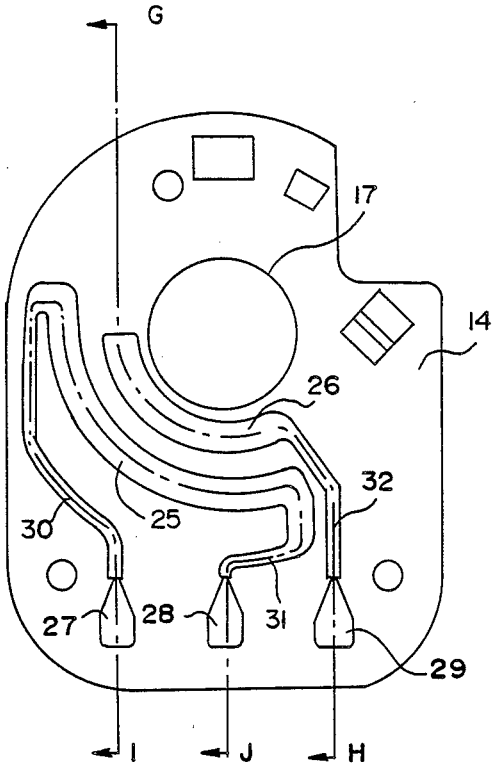
FIG. 3 is a plan view of a circuit board of the throttle sensor of FIG. 1.

Referring to FIG. 3, a resistance body 25 and a collecting body 26 are disposed on the circuit board 14 and formed along the path of movement of the brushes 21 and 22, respectively. Three electrodes 27, 28 and 29, are formed on the end of the circuit board 14. The brushes 21 and 22 move in contact with the resistance body 25 and the collecting body 26, respectively. One end of the resistance body 25 is connected with the electrode 27 through an integral lead portion 30, and the other end of the resistance body 25 is connected with the electrode 28 through an integral lead portion 31. One end of the collecting body 26 is connected with the electrode 29 through an integral lead 32. Three lead in wires 33, 34 and 35, are soldered through electrodes 27, 28 and 29 respectively.

Figure 4:
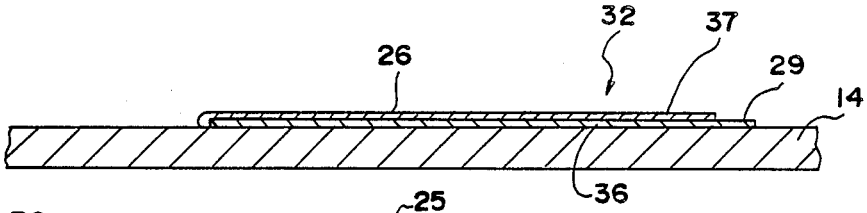
FIG. 4 is a cross-sectional view taken on the line G-H of FIG. 1.
Figure 5:
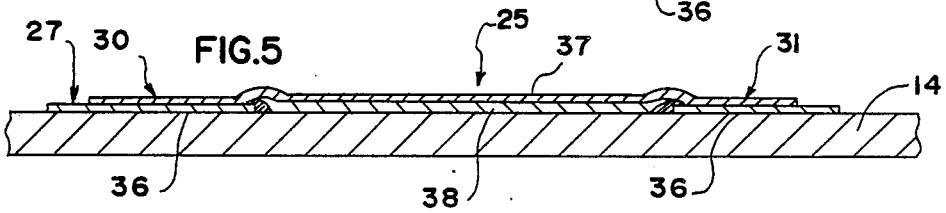
FIG. 5 is a cross-sectional view taken on the line I-J of FIG. 3.
Figure 6:
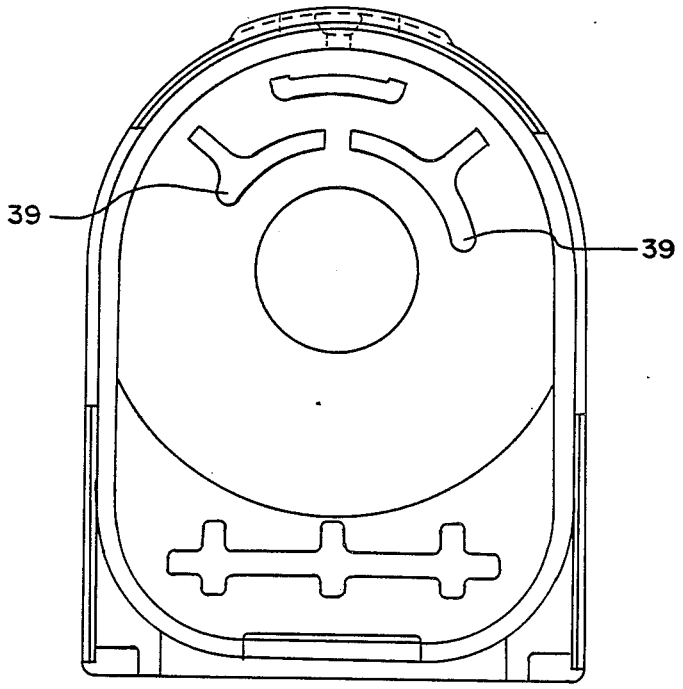
FIG. 6 is a plan view of the throttle sensor of FIG. 1.

The resistance body 25 is so shaped that the position of the sliding body 18 is located at a position which is 13% and 87% of the resistance body 25 when the throttle valve is opened and closed completely respectively. Referring to FIG. 6, the cover is provided with stoppers 39, which limit the rotation of the sliding body 18. These stoppers 39 limit the rotation to between 13% and 87% of the resistance body 25. Referring to FIG. 4, the collecting body 26 and the wire 32 are comprised of an electrically-conductive layer 36 which is made of copper foil, and a protective resistance layer 37, which is formed on the electrically-conductive layer 36. Referring to FIG. 5, the resistance body 25 is comprised of a basic resistance layer 38 and a protective resistance layer 37, which is formed on the basic resistance layer 38. The amount of resistance of the basic resistance layer 38 and the amount of the resistance of the protective resistance layer 37 are 404 ohms/square and 3 kiloohms/square respectively. The resistance of the body 25 between the lead-in wires 28 and 31 is about 5 kiloohms/s. The method for making circuit board includes etching a conductive layer 36 on a board 14 of alumina. A paste of ruthenium oxide is screen printed on the board as the basic resistance layer 38. The board is then subjected to a levelling process for ten minutes, and is then dried for fifteen minutes at 100° C. and burned. The burning condition involves a 60-minute process wherein a peak temperature of 850° C. is maintained for ten minutes. Next, a paste of ruthenium oxide is screen printed as the protective resistance layer 37, and is dried and burned in the same manner as described above.

Figure 7:
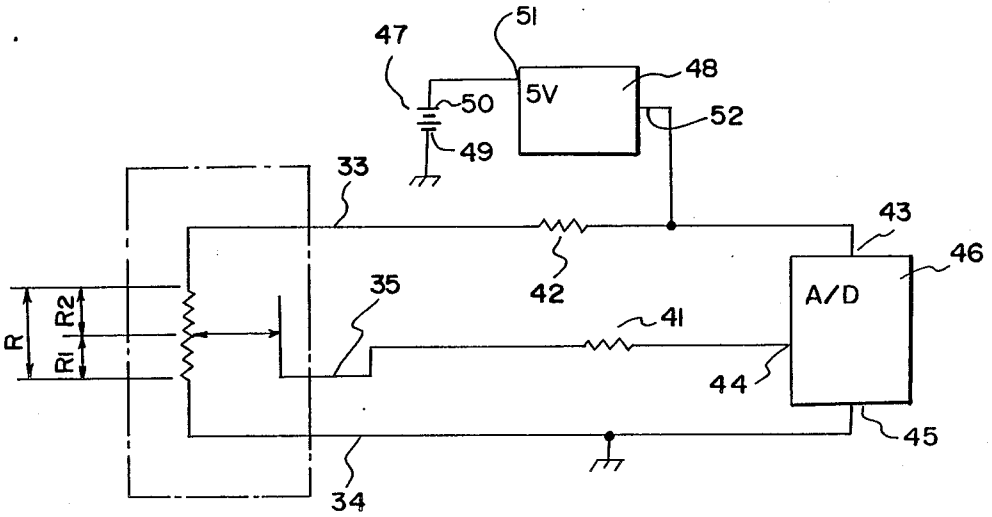
FIG. 7, is a circuit diagram associated with the throttle sensor of FIG. 1.

Referring to FIG. 7, the lead wire is connected to the input terminal 44 of an A/D converter 46 through a resistance 41. The lead wire 34 is connected to a ground terminal 45 of the A/D converter 46, and a ground terminal 49 of a battery 47 whose voltage is approximately 14 volts. An input terminal 51 of a 5-volt regulator 48 is connected to the positive terminal 50 of the battery 47. An output terminal 52 of the 5-volt regulator 48 is connected to a power terminal 43 of the A/D converter 46 and connected to the lead-in wire 33 thru a resistance 42 having a resistance which is smaller than that of the resistance of the resistance body 25.

In operating the above described apparatus, the voltage regulator provides a voltage of 5 volts. The amount of resistance 42 is so much smaller than that of the resistance 25 that approximately 5 volts is supplied to the resistance 25. When the accelerator pedal is depressed, the axle 19 is rotated according to a stepped amount, and the sliding element 20 rotates relative to the circuit board 14. The brush 21 which is disposed on the sliding element 20 moves along the surface of the resistance body 25, and the brush 22 moves along the surface of the collecting body 26. The voltage according to the position of the brush 21 is applied to the brush 21 and is changed according to the opening of the throttle valve. This voltage is applied to the input terminal 44 of the A/D converter 46 through the lead-in wire 35 and the resistance 41. In the A/D converter 46 the voltage is changed to a digital signal and sent to a control circuit (not shown). In the control circuit, the position of the sliding device which is indicative of the condition of the throttle valve is estimated and used to control an automatic transmission or the like.

The degree of rotation of the element 18 is between 13% and 87% of the length of the resistance body 21 as a result of the stopper 39 and projections 40. The amount of the resistance of the resistance body 25 is about 5 kiloohms so that a resistance which exceeds 650 ohms exists between the lead-in wires 33 and 35, and between the lead-in wires 34 and 35 in each position of the sliding body 18. Accordingly, when the battery voltage, which is about 14 volts, is supplied between the lead-in wires 33 and 35 and between the lead-in wires 34 and 35, the electric power of the throttle sensor is 0.3 Watts so that the throttle sensor will not cause an accident.

The surface of the basic resistance layer 38 is covered by the protective resistance layer 37, the basic resistance layer 38 is therefore not exposed directly to the outside, and is protected from temperature, humidity and dust. Moreover, the sliding element 20 moves with the brush in contact only with the protective resistance layer 37 so that the basic resistance layer 38 is not subjected to friction. The protective resistance layer 37 is rubbed by the sliding element 20, but the protective resistance layer 37 and the basic resistance layer 38 are connected to each other so that the resistance of the protective resistance layer 37 is 2-500 times against the basic resistance layer 38 so that the volume of the resistance body is not changed by the friction at the surface of the protective resistance layer 37.

For this reason, the present throttle sensor has good precision and a long life. Further, it is not necessary to provide a perfectly sealed solid enclosed structure, and therefore the casing 11 may be miniaturized. When water enters the inside of the throttle sensor, the water may be discharged from the hole 53 so that there is no danger of a short circuit.

While a preferred embodiment of the present invention has been described, it is to be understood by those in the art that various changes in form and details may be made therein without departing from the spirit and scope of the invention.

What is claimed is:

1. A throttle sensor for an internal combustion engine comprising:

a circuit board;

a sliding body rotatably disposed adjacent said circuit board for rotation corresponding to the opening of a throttle valve for said internal combustion engine:

sliding means comprising an electrical conductor secured to said sliding body and including at least one brush mounted for engagement with said circuit board;

a resistance body, including a basic resistance layer and a protective resistance layer on said circuit board, said resistance body being disposed in engagement with said at least one brush with said basic resistance layer being covered by said protective resistance layer, said protective resistance layer having a resistance per unit area larger than the resistance of said basic resistance layer; and lead means connected to said resistance body.

2. A throttle sensor for an internal combustion engine according to claim 1 further comprising a collecting body including an electrically conductive layer and another protective resistance layer on said circuit board, and an additional brush on said sliding element disposed in contact with said collecting body, said electric conductive layer being covered by said another protective resistance layer.

3. A throttle sensor for an internal combustion engine as set forth in claim 2 further comprising additional lead means connected to said collecting body.

4. A throttle sensor for an internal combustion engine according to claim 1 further comprising a housing supporting said circuit board and a cover for covering said circuit board.

5. A throttle sensor for an internal combustion engine according to claim 4 further comprising a hole formed in said cover for discharging water.

6. A throttle sensor for an internal combustion engine according to claim 1 further comprising stopper means for limiting rotation of said sliding body.

* * * * *